US011402776B2

(12) United States Patent
Iwasaki

(10) Patent No.: US 11,402,776 B2
(45) Date of Patent: Aug. 2, 2022

(54) IMAGE HEATING APPARATUS AND IMAGE FORMING APPARATUS

(71) Applicant: CANON KABUSHIKI KAISHA, Tokyo (JP)

(72) Inventor: Atsushi Iwasaki, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/208,127

(22) Filed: Mar. 22, 2021

(65) Prior Publication Data

US 2021/0294250 A1 Sep. 23, 2021

(30) Foreign Application Priority Data

Mar. 23, 2020 (JP) ..... JP2020-050963

(51) Int. Cl.
*G03G 15/20* (2006.01)

(52) U.S. Cl.
CPC ..... *G03G 15/2039* (2013.01)

(58) Field of Classification Search
CPC ..... G03G 15/2039
See application file for complete search history.

(56) References Cited

U.S. PATENT DOCUMENTS 8,891,989 B2 11/2014 Umeda et al.
9,291,991 B2 3/2016 Yoshida
10,379,471 B2 8/2019 Takematsu et al.
2005/0254845 A1* 11/2005 Taki ..... G03G 15/2064 399/45
2009/0162116 A1 6/2009 Mogi et al.
2012/0243894 A1* 9/2012 Umeda ..... G03G 15/2032 399/68

(Continued)

FOREIGN PATENT DOCUMENTS

JP H07-129018 A 5/1995
JP 2004-117802 A 4/2004

(Continued)

OTHER PUBLICATIONS

Extended European Search Report dated Aug. 10, 2021 in counterpart European Patent Appln. No. 21163138.7.

*Primary Examiner* — Clayton E. LaBalle
*Assistant Examiner* — Michael A Harrison
(74) *Attorney, Agent, or Firm* — Venable LLP

(57) ABSTRACT

Provided is an image heating apparatus including: a film that contacts with the recording material; a heater unit configured to be in contact with an inner surface of the film, the heater unit including a heater, and a heater support supporting the heater, wherein the heater is fixed to the heater support; a pressing roller that forms a nip together with the heater unit through the film, the nip being for nipping and conveying a recording material; a pressing member that presses the heater toward the pressing roller without through the heater support; a pressing force adjustment mechanism for adjusting pressing force in the nip; and a control portion that controls the pressing force adjustment mechanism, wherein the control portion causes the pressing force adjustment mechanism to adjust the pressing force based on temperature detected by a temperature detection member that detects temperature of the heater.

20 Claims, 10 Drawing Sheets

(56) References Cited

U.S. PATENT DOCUMENTS

| | | | | |
|---|---|---|---|---|
| 2015/0338804 | A1* | 11/2015 | Nakashima | H05B 3/141 219/216 |
| 2017/0371283 | A1* | 12/2017 | Fujita | G03G 15/2042 |
| 2018/0173139 | A1 | 6/2018 | Tanto | |

FOREIGN PATENT DOCUMENTS

| | | | |
|---|---|---|---|
| JP | 2011-033654 | A | 2/2011 |
| JP | 2012-198475 | A | 10/2012 |
| JP | 2016-012077 | A | 1/2016 |
| JP | 2017-142428 | A | 8/2017 |

* cited by examiner

IMAGE HEATING APPARATUS AND IMAGE FORMING APPARATUS

BACKGROUND OF THE INVENTION

Field of the Invention

The present invention relates to an image heating apparatus used in an image forming apparatus such as a copying machine or a laser beam printer.

Description of the Related Art

An image forming apparatus, such as a copying machine of an electrophotographic system or a laser beam printer, includes a transfer device for transferring a toner image onto a recording material and an image heating apparatus for heating and pressing the toner image for fixation on the recording material (hereinafter referred to as a fixing apparatus). The image forming apparatus may cause disruption of the conveyance of recording materials, known as jamming, due to some sort of error. Japanese Patent Application Publication No. H07-129018 discloses a technique in which a recording material detection unit for detecting residual of a recording material on a fixing apparatus and a pressing force release mechanism for releasing pressing force of the fixing apparatus are provided to allow pressing with the fixing apparatus to be automatically released when jamming is detected, thereby facilitating removal of jammed recording materials from the fixing apparatus.

There is also disclosed a technique in which when power to an image forming apparatus is turned off or during transfer to a sleep mode in which the image forming apparatus is not used for a while, pressing of a fixing apparatus is automatically released to prevent deterioration such as deformation of a fixing member due to pressing for a long time.

Proposed examples of a heating method of a fixing apparatus include a heated roller method using a fixing roller in the form of a cylindrical body incorporating a halogen heater and the like, and a pressing roller, and a film heating method as a heating method capable of achieving power saving in a fixing apparatus. Examples of a fixing apparatus in the film heating method include a fixing apparatus in which a slide nip portion (hereinafter referred to as an inner surface nip portion) is formed by a tubular belt (hereinafter referred to as a film) with low heat capacity, made of mainly heat-resistant resin or metal, a heating body (hereinafter referred to as a heater) made of ceramic or the like, being in slide contact with an inner surface of the cylindrical belt, and a heating body support. (hereinafter referred to as a heater support or a heater holder), and a press contact nip portion (hereinafter referred to as a fixing nip portion) is formed by pressing by a pressing member through the film.

This type of fixing apparatus is configured such that a heater is attached to a heater holder, and pressing members such as a thermistor for detecting temperature of the heater, a thereto switch as a safety element, and a connector for supplying power to the heater are inserted through a hole provided in a heater support seat surface of the heater holder to press the heater. These pressing members are supported in press contact with the heater, and force acts in a direction in which the heater is separated from the heater holder.

When pressing of the fixing apparatus is automatic ally released in the image forming apparatus in states such as when jamming is detected, when power is turned off, and during transfer to a sleep mode, and the heater is pulled away from the heater holder by pressing from the pressing member described above, supporting states of the pressing members change. This may cause temperature detection by the thermistor and operation conditions of the safety element to be unstable, or cause an edge portion of the heater to come into contact with and damage the inner surface of the film. Japanese Patent Application Publication No. 2016-12077 discloses a configuration for suppressing separation of a heater using the pressing member described above by interposing an adhesive agent at a predetermined space between the heater and a heater holder so as to support the heater.

Typical examples of the adhesive described above include an adhesive of a silicone rubber system, having elasticity, which is used to absorb stress due to difference in coefficient of thermal expansion between the heater and the heater holder and endure a high temperature of 200° C. or more.

Unfortunately, the silicone rubber-base adhesive typically has characteristics in which the adhesive itself softens as temperature increases above normal temperature, and thus being likely to cause scratching. When pressing of a fixing apparatus is automatically released as described above, the adhesive tends to stretch in a direction in which the heater is separated from the heater holder due to pressing force of the pressing members. In particular, a high temperature state, such as when jamming is detected, causes the adhesive to stretch more, so that a large load is applied to an interface (adhesive interface) between the heater or the heater holder and the adhesive by the action of elastic restoring force of the adhesive. When such a load is repeatedly applied, adhesive strength in the adhesive interface gradually decreases causing adhesive peeling to be likely to occur. This may cause the number of repeats of pressure release, such as the number of jamming occurrences or the number of turning off power, to be a rate-limiting value of the life of the fixing apparatus.

In recent years, control of the transfer to a sleep mode immediately after the finish of a print job is becoming a standard from the viewpoint of saving energy used by the image forming apparatus. This causes an increase in the frequency of release of the pressing the fixing apparatus in a high temperature state, and thus is an increasing influence on the life of the fixing apparatus.

An object of the present invention is to provide a technique capable of reducing the influence of the release of pressing on the life of an image heating apparatus by improving pressing release control of the image heating apparatus to prevent a decrease in adhesive strength between a heater and a heater support.

SUMMARY OF THE INVENTION

To achieve the object above, an image heating apparatus of the present invention includes the following:

a film formed in a tubular shape and configured to rotate in contact with the recording material;

a heater unit configured to be in contact with an inner surface of the film, the heater unit including a heater, and a heater support configured to support the heater in a longitudinal direction of the heater, wherein the heater is fixed to the heater support with an adhesive;

a temperature detection member configured to detect the temperature of the heater;

a pressing roller configured to be in contact with an outer surface of the film and to form a nip together with the heater unit through the film, the nip being for nipping and conveying the recording material;

a pressing spring configured to press the heater toward the pressing roller through the heater support for forming the nip;

a pressing member configured to press the heater toward the pressing roller without through the heater support;

a pressing force adjustment mechanism configured to adjust the pressing force by the pressing spring; and a control portion configured to control the pressing force adjustment mechanism;

wherein the control portion causes the pressing force adjustment mechanism to adjust the pressing force based on the temperature detected by the temperature detection member.

To achieve the object above, an image forming apparatus of the present invention includes the following:

an image forming portion configured to form an image on a recording material; and a fixing portion configured to five an image formed on a recording material on the recording material, wherein the fixing portion is the image heating apparatus of the present invention.

The present invention enables a reduction in the influence of the release of pressing on the life of the image heating apparatus by preventing a decrease in adhesive strength between the heater and the heater support.

Further features of the present invention will become apparent from the following description of exemplary embodiments with reference to the attached drawings. Each of the embodiments of the present invention described below can be implemented solely or as a combination of a plurality of the embodiments. Also, features from different embodiments can be combined where necessary or where the combination of elements or features from individual embodiments in a single embodiment is beneficial.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Embodiment 1

Figure 1:
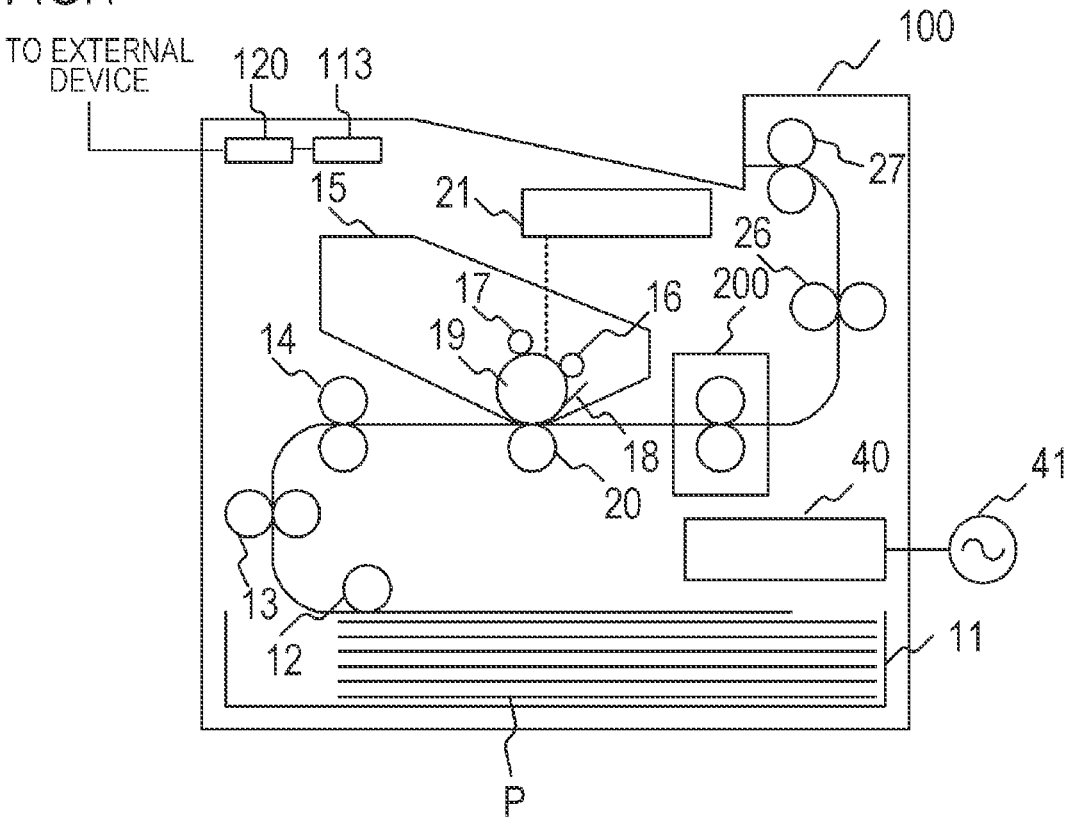
FIG. 1 is a sectional view of an image forming apparatus 100.

FIG. 1 is a sectional view of a laser printer (image forming apparatus) 100 using an electrophotographic recording technique. Examples of an image forming apparatus to which the present invention is applicable include a copying machine and a printer, using an electrophotographic system and an electrostatic recording system. Then, a case is here described where the present invention is applied to a laser printer forming an image on a recording material P, using the electrophotographic system.

A video controller 120 receives and processes image information and a print instruction that are transmitted from an external device, such as a personal computer. A control portion 113 is connected to the video controller 120, and controls each unit constituting an image forming apparatus in response to an instruction from the video controller 120. When the video controller 120 receives a print instruction from the external device, image formation is performed by movement below.

When a print signal is generated, a scanner unit 21 emits a laser beam modulated according to image information, and then a photoreceptor 19, which is electrostatically charged to a predetermined polarity by an electrostatic charge roller 16, is scanned. This causes an electrostatic latent image to be formed on the photoreceptor 19. A developing device 17 supplies toner to the electrostatic latent image to form a toner image corresponding to the image information on the photoreceptor 19. Then, recording materials (recording paper sheets) P stacked in a paper feed cassette (paper feeding portion) 11 are fed one by one by a pickup roller 12, and conveyed toward the resist roller 14 by a roller 13. The recording materials P are further conveyed to a copying position from the resist roller 14 in synchronization with timing when the toner image on the photoreceptor 19 reaches the copying position defined by the photoreceptor 19 and a transfer roller 20. In the course where the recording materials P pass through the copying position, the toner image on the photoreceptor 19 is copied to each of the recording materials P. Then, the recording materials P are heated by a fixing apparatus (image heating apparatus) 200 as a fixing portion (image heating portion) and the toner image is heated and fixed on each of the recording materials P. Each of the recording materials P each supporting the fixed toner image is ejected into a tray in an upper portion of a laser printer 100 by rollers 26 and 27. A cleaner for cleaning the photoreceptor 19 is designated as 18. Electric power is supplied to a fixing apparatus 200 from a control circuit 40 connected to a commercial AC power source 41. The photoreceptor 19, the electrostatic charge roller 16, the scanner unit 21, the developing device 17, and the transfer roller 20, which are described above, constitute an image forming portion that forms a non-fixed image on each of the recording materials P. A cartridge as an exchange unit is designated as 15.

Figure 2:
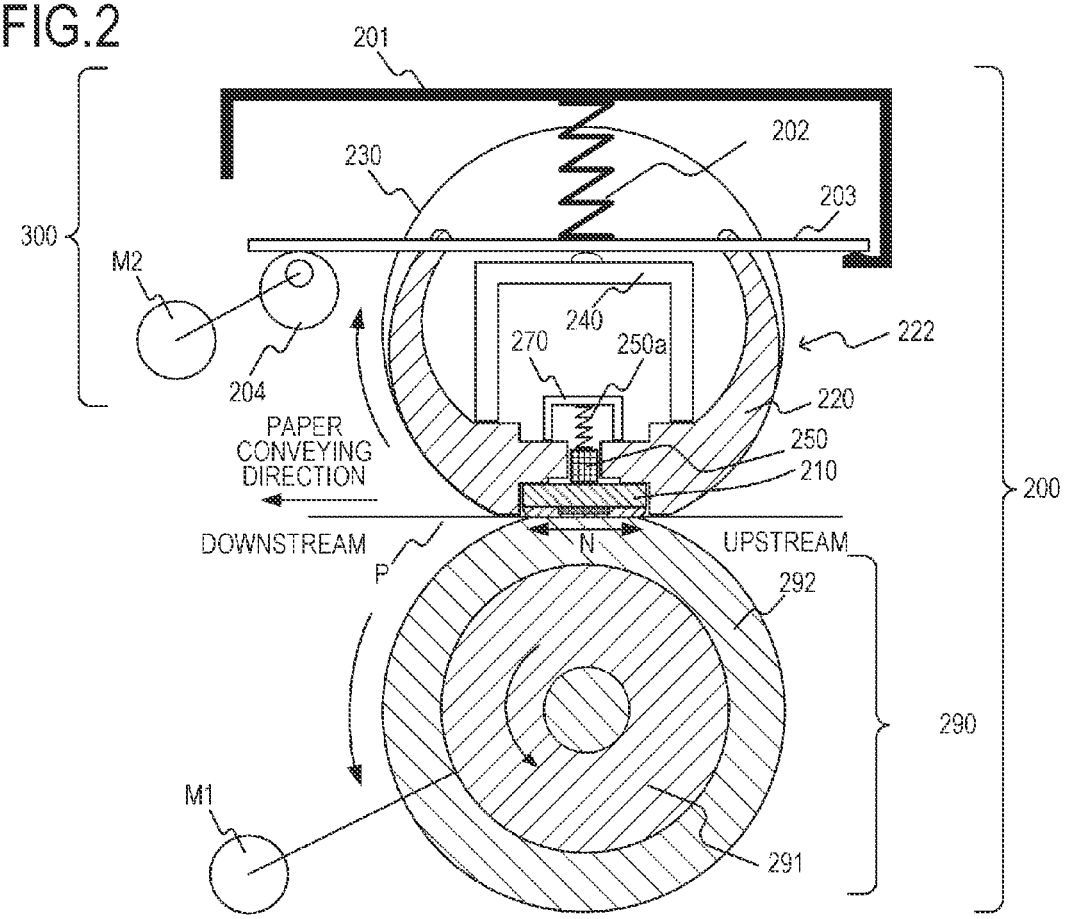
FIG. 2 is a sectional view of a fixing apparatus 200.

FIG. 2 is a sectional view of the fixing apparatus 200. The fixing apparatus 200 includes a heater 210 in a thin-walled shape as a heating body, a heater holder 220 as a heating body support member (heater support), and a film 230 in a tubular shape that travels and moves as a mover while being in slide contact with the heater 210. The fixing apparatus 200 further includes a thermistor 250 as a temperature detection member that detects temperature of the heater 210, and a pressing roller 290 as a pressing member that forms a fixing nip portion N as a press contact nip nipping each of the recording materials P with a predetermined pressing force together with the heater 210 through the film 230, the fixing nip portion N being formed between an outer surface of the film 230 and the pressing roller 290. The fixing apparatus 200 also includes a pressing mechanism 300 as a pressing force adjustment mechanism capable of applying or releasing pressing force for forming the fixing nip portion N.

The film 230 may include a base made of heat-resistant resin such as polyimide or metal such as stainless steel, and an elastic layer of the heat-resistant rubber or the like, and a release layer made of the heat-resistant resin, may be provided on the base. The pressing roller 290 includes a core metal 291 made of material such as iron or aluminum, and an elastic layer 292 made of material such as silicone rubber. The pressing roller 290 rotates in an arrow direction by receiving power from a motor M1. The heater 210 is mainly made of ceramic such as alumina or metal such as stainless steel (SUS), and provided with a resistance heating element that generates heat when being energized. The heater 210 is supported by the heater holder 220 made of heat-resistant resin, such as a liquid crystal polymer, using an adhesive described later.

Figure 3A:
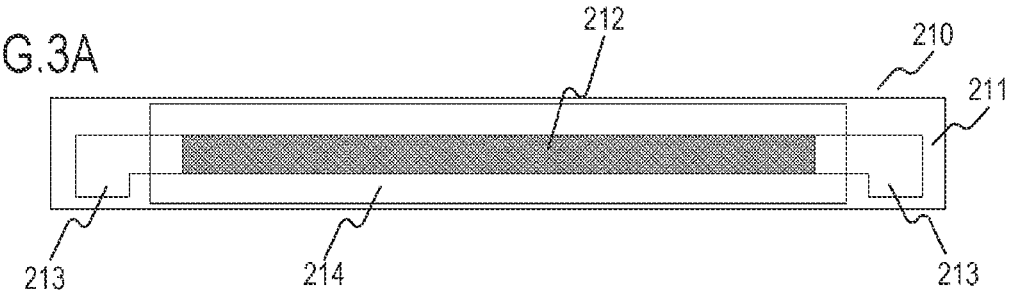
FIGS. 3A to 3C are explanatory views illustrating adhesive structure between a heater 210 and a heater holder 220 in Embodiment 1.
Figure 3B:
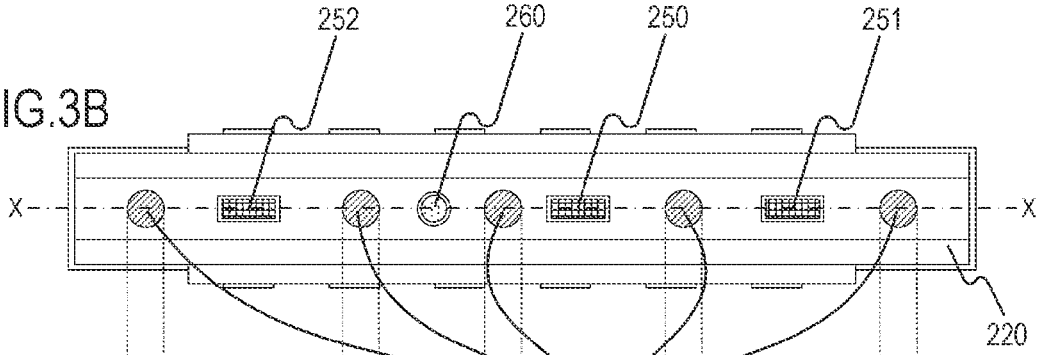
Figure 3C:
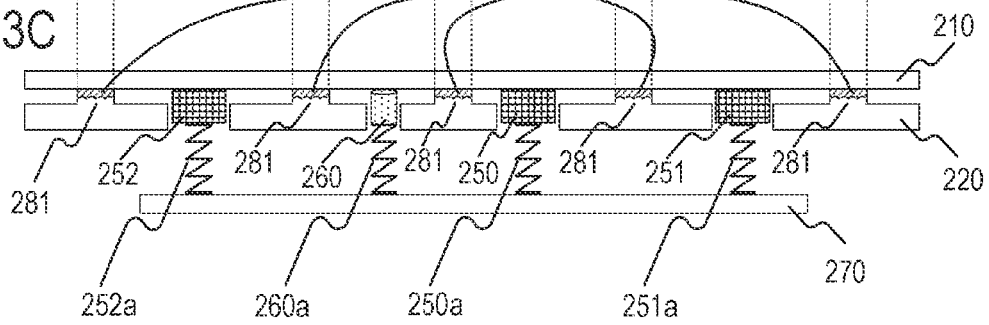

The heater 210 has a surface opposite to a sliding contact surface with the film 230, and pressing members such as the thermistor 250 and a safety element 260 illustrated in FIGS. 3A to 3C are disposed in contact with the surface, and thus pressing the heater 210 in a direction in which the heater 210 is peeled from the heater holder 220. The thermistor 250 is a temperature detection member for detecting temperature of the heater 210 and feeding back the temperature to control of temperature. The present embodiment uses a unit member that is formed by supporting a resistance element that changes in resistance in accordance with temperature on a heat-resistant member such as ceramic paper, and insulating and protecting the resistance element with a pressure-resistant member such as a polyimide film. The thermistor 250 is disposed in contact with the heater 210 using pressing force of a thermistor pressing spring 250*a* held by a pressing member holder 270. The safety element 260 is a protection element such as a thermo switch or a temperature fuse that operates in an abnormal high temperature state to shut off electric power to be supplied to the heater 210, and thus preventing the heater 210 from excessively increasing in temperature. The safety element 260 is disposed in contact with the heater 210 using pressing force of a safety element pressing spring 260*a* held by the pressing member holder 270.

The heater holder 220 has a surface opposite to a surface supporting the heater, and a pressing stay 240 that is a thick-walled member formed of a rigid member such as metal is disposed in contact with the surface, and thus forming the fixing nip portion N by applying pressing force toward the pressing roller 290.

The pressing mechanism 300 includes a fixing frame 201, a pressing spring 202, a pressing plate 203, and a pressing release cam 204. The pressing mechanism 300 applies pressing force of the pressing spring 202 held by the fixing frame 201 to opposite ends of the pressing stay 240 as a second pressing member in a longitudinal direction using the pressing plate 203. When the pressing force is transmitted toward the pressing roller 290 through a contact region with the heater holder 220, the fixing nip portion N is formed. The present embodiment allows the heater 210, the heater holder 220, the pressing stay 240, and the like to constitute a heater unit 222 that is in contact with an inner surface of the film 230.

Then, the pressing release cam 204 is disposed in contact with the pressing plate 203, and a command to release pressing force of the fixing apparatus 200 causes the pressing release cam 204 to be turned by a predetermined amount using power from a motor M2 to lift the pressing plate 203, and thus enabling the pressing force forming the fixing nip portion N to be released. An operation flow of releasing pressing force of the fixing apparatus 200 will be described later in detail. The release of pressing three in the present embodiment includes not only causing no pressing but also reducing pressing force required to heat and fix a toner image on a recording material P to the extent of allowing jamming treatment and deformation of a fixing member.

FIGS. 3A to 3C are explanatory views illustrating adhesive structure between a heater 210 and a heater holder 220.

FIG. 3A is a plan view of the heater 210 as viewed from a fixing nip portion N side. The heater 210 includes a base plate 211 on which a resistance heating element layer 212 that generates heat by being energized, an electrode 213 for energizing the resistance heating element layer 212, and a protective layer 214 that insulates and protects the resistance heating element layer 212 are formed. Although in the present embodiment, a surface provided with the resistance heating element 212 is configured to slide on the film 230, and an opposite surface is configured to be bonded to the heater holder 220, the surface provided with the resistance heating element 212 may be configured to be bonded to the heater holder 220.

FIG. 3B is a plan view of a heater support surface of the heater holder 220 as viewed from the fixing nip portion N side, and FIG. 3C is a sectional view of the heater 210 and the heater holder 220 that are bonded to each other with an adhesive 280, being taken along line X-X in FIG. 3B.

The heater holder 220 has the heater support surface in which through-holes are each opened at a predetermined place in a longitudinal direction, and thermistors 250, 251, and 252, and the safety element 260 are disposed passing through the corresponding through-holes to come into contact with the heater 210. In the present embodiment, the respective thermistors and the safety element each have a pressing force of 5N.

Adhesive points 281 are provided across the corresponding thermistors 250, 251, and 252, and across the safety element 260 in the longitudinal direction of the heater holder 220 so that the heater 210 and the heater holder 220 are bonded to each other with the adhesive 280 of a silicone rubber system. The adhesive points 281 in the heater holder 220 each have a surface profile provided with unevenness to increase an adhesive area in the present embodiment. Besides this, the surface profile may be planar, or blast treatment may be applied to the surface, for example.

For the adhesive 280 in the present embodiment, the adhesive KE-3417 of a silicone rubber system, a one-pack type, and a condensation reaction type (humidity curing), available from Shin-Etsu Chemical Co., Ltd. is used. Besides this, the adhesive 280 may be a two-pack type, and an addition reaction type (thermal curing), or may be an adhesive of a rubber system having a heat resistance of 200° C. or more. Additionally, a primer may be separately used to enhance adhesive strength. Each of the adhesive points 281 has a coating range of a diameter of 5 mm, and the amount of coating of the adhesive 280 that is 10 mg.

Next, temperature properties of adhesive strength of the adhesive 280 acquired 1*w* the present inventors through prior examination will be described. The adhesive strength in the present embodiment indicates interface peeling force between the adhesive 280 and the heater holder 220, or interface peeling force between the adhesive 280 and the heater 210, and does not indicate breaking strength of the adhesive itself.

The present inventors performed the prior examination as follows to measure adhesive strength per one adhesive point.

An assembly for evaluation was formed as follows: a portion in the heater holder 220, including one adhesive point and two through-holes opened across the one adhesive point in the longitudinal direction, was cut out; and a part cut out from of the heater 210 in a length similar to a length of the portion cut out was bonded to the portion under the conditions described above without assembling the thermistor and the safety element. The assembly for evaluation was placed with its heater exposure surface on a hot plate adjustable from normal temperature to 230° C., and the heater was pressed through the two through-hole toward the hot plate using a heater pressing tool. After the heater sufficiently increases in temperature, the assembly was pulled with a force gauge in a direction in which the heater 210 is separated from the heater holder 220. Then, a peak value of tensile strength when an adhesive interface was peeled was defined as interface peeling force or simply adhesive strength.

Figure 4:
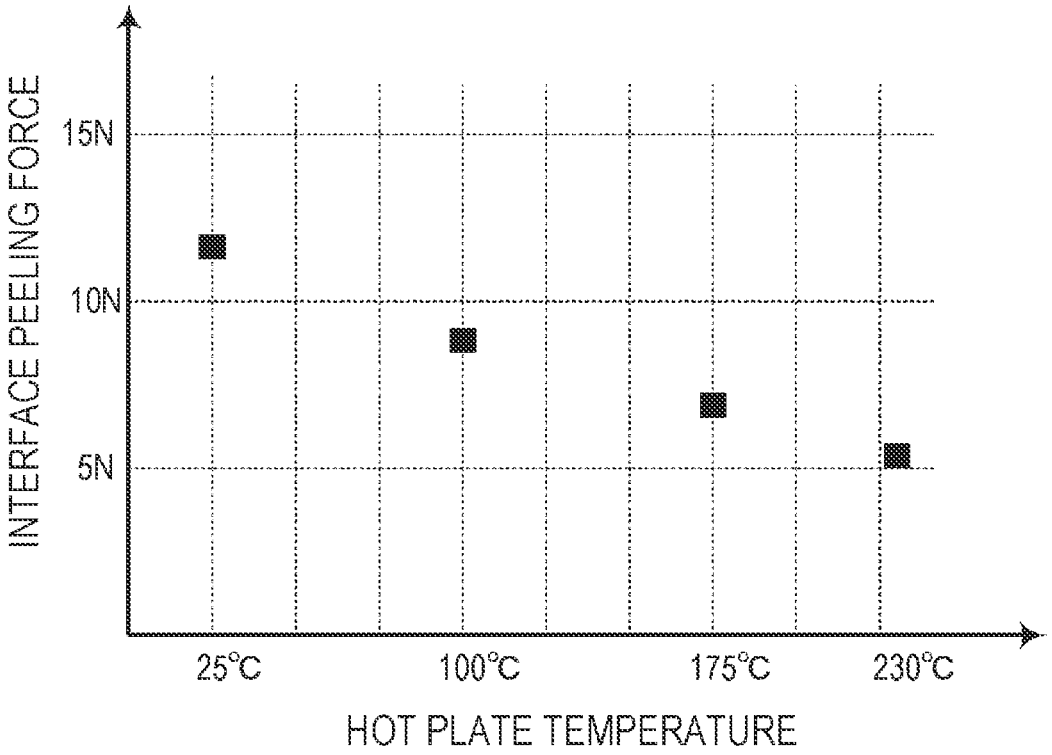
FIG. 4 shows temperature properties of interface adhesive strength of an adhesive 280.

FIG. 4 shows a tendency of hot plate temperature versus interface peeling force acquired using the assembly for evaluation described above. As shown in FIG. 4, the interface peeling force decreases from the normal temperature toward high temperature, and the interface peeling force at 230° C. is half or less of that at the normal temperature in the present embodiment, and thus it is found that the interface can be peeled with smaller force as temperature increases.

Figure 5A:
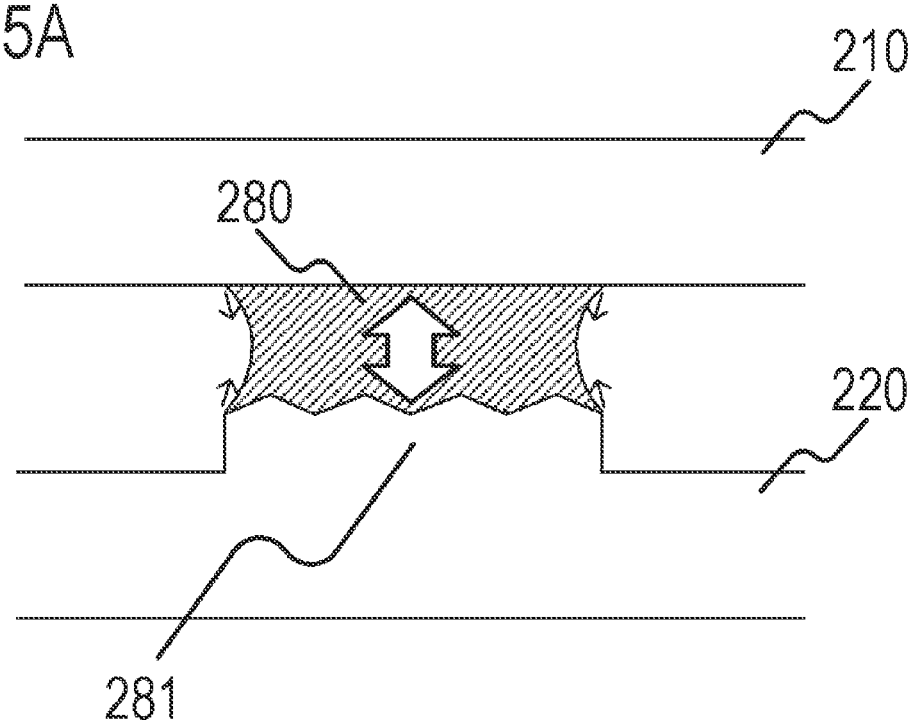
FIGS. 5A and 5B illustrate a mechanism of temperature properties of interface peeling force of the adhesive 280.
Figure 5B:
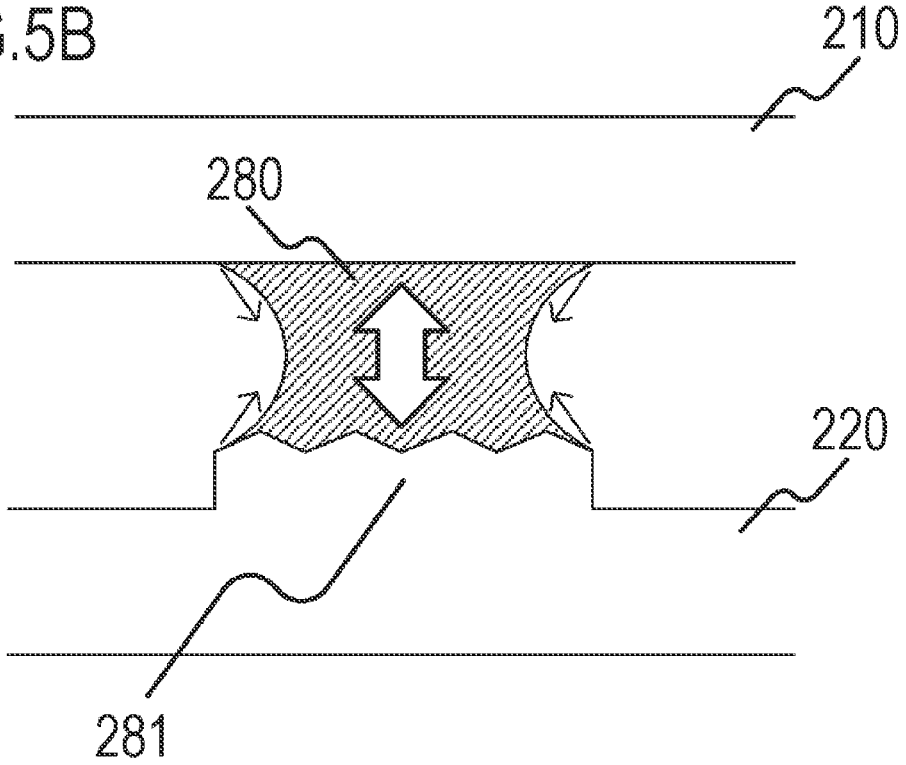

FIGS. 5A and 5B illustrates a mechanism of temperature properties of interface peeling force of as described above. When predetermined tensile strength, or a force of 5N, for example, separating the heater 210 from the heater holder 220, is applied to the assembly for evaluation, FIG. 5A illustrates a schematic state of the adhesive 280 at the normal temperature and FIG. 5B illustrates that at 230° C., In comparison between FIGS. 5A and 5B, when the heater 210 and the heater holder 220 are pulled at equal force, it is found that the amount of elongation of the adhesive in a tensile direction differs (hollow arrow). This is due to typical characteristics of the adhesive of a silicone rubber system, in which the adhesive softens as temperature increases from the normal temperature, and thus being likely to stretch. However, the rubber itself is not softened and deteriorated, so that hardness and elongation of the rubber return to original values when temperature returns to the normal temperature.

When the adhesive is pulled, the adhesive has a sectional shape narrow in the middle like a hand drum. At this time, the adhesive 280 tends to return to the original state using its elastic restoring force, and thus large stress (diagonal arrows in FIGS. 5A and 5B) is applied to an adhesive interface between the adhesive 280 and the heater 210 or the heater holder 220, especially an edge portion of an adhesive surface.

Then, the amount of constriction increases more in FIG. 5B at temperature higher than the normal temperature in FIG. 5A because the amount of elongation of the adhesive in FIG. 5B is larger than that in FIG. 5A. This causes also increase in the stress described above applied to the edge of the adhesive interface. Thus, temperature properties are shown in which the adhesive interface can be peeled with a smaller force as temperature rises as in FIG. 4.

Next, control of the fixing apparatus 200 in the present embodiment will be described. In the present embodiment, a film surface temperature required to fix a toner image to the recording material P is 180° C. Adjusting the thermistor 250 in a paper passing portion to 200° C. to 230° C. in accordance with a heated level of the fixing apparatus 200 enables desired film temperature to be acquired. Then, the adhesive 280 is exposed to a temperature similar to that of the thermistor near the corresponding one of the adhesive points.

The fixing apparatus 200 or the laser printer 100 mounted with the fixing apparatus 200 here includes recording material jam detection unit (not illustrated), and thus is capable of detecting residual of the recording material P in the fixing apparatus 200 when jamming is detected.

The fixing apparatus 200 or the laser printer 100 mounted with the fixing apparatus 200 also includes a power switch (not illustrated) as power source switching member for controlling start and stop of the apparatus, so that switching the power switch enables power of the apparatus to be turned on and off.

Additionally, the fixing apparatus 200 or the laser printer 100 mounted with the fixing apparatus 200 has a normal power mode of fixing a toner image on the recording material P, and a sleep mode as a saving-power mode with less power consumption. When the apparatus is not used for a predetermined time during the normal power mode, the apparatus transfers to the sleep mode. When receiving a print signal during the sleep mode, the apparatus returns to the normal power mode.

The laser printer 100 mounted in the fixing apparatus 200 performs operation of releasing pressing force of the fixing apparatus 200 in the following cases.

(1) The recording material P remains in the fixing apparatus 200 when the laser printer 100 detects jamming.

(2) Power of the laser printer 100 is turned off.

(3) The laser printer 100 transfers to the sleep mode.

Then, operation of applying pressing force to the fixing apparatus 200 is performed in the following cases.

(4) The recording material P remaining in the fixing apparatus 200 is removed.

(5) Power of the laser printer 100 is turned on.

(6) The laser printer 100 is returned from the sleep mode.

Figure 6:
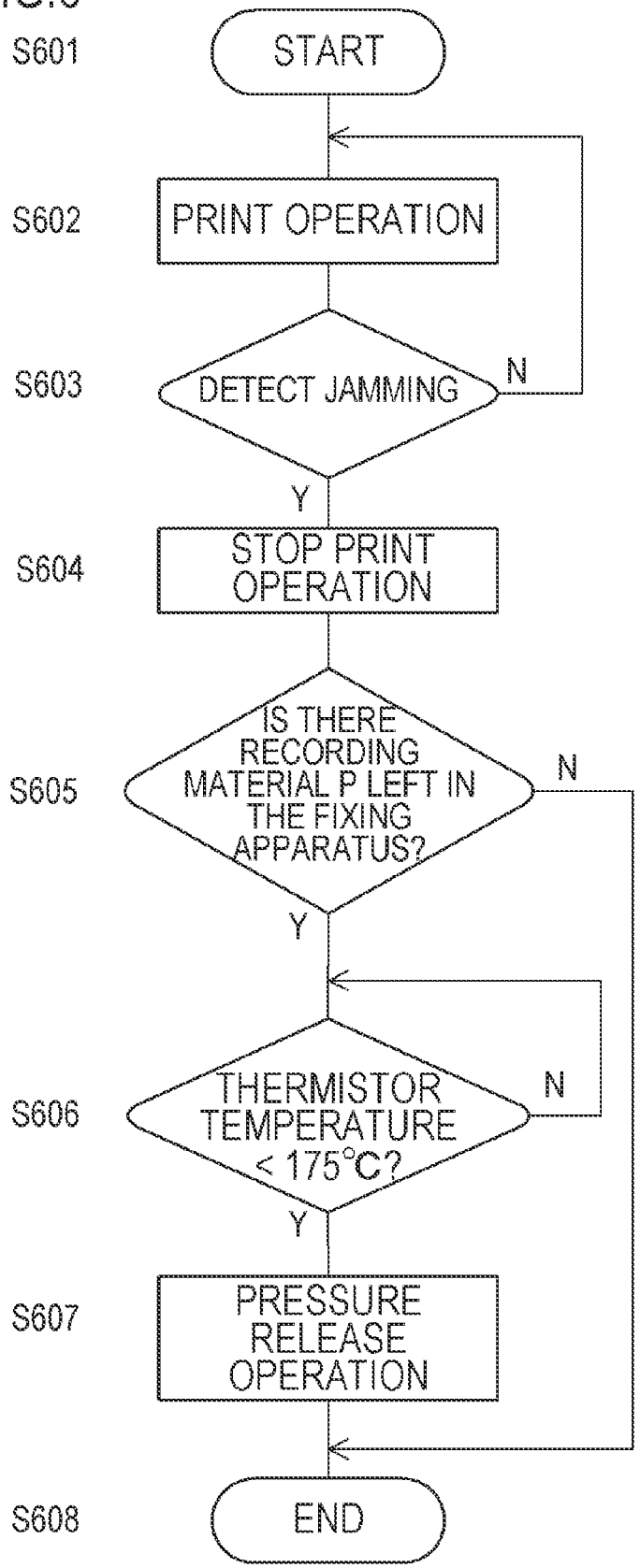
FIG. 6 is a flowchart of control of pressure release when jamming of a recording material P is detected.
Figure 7:
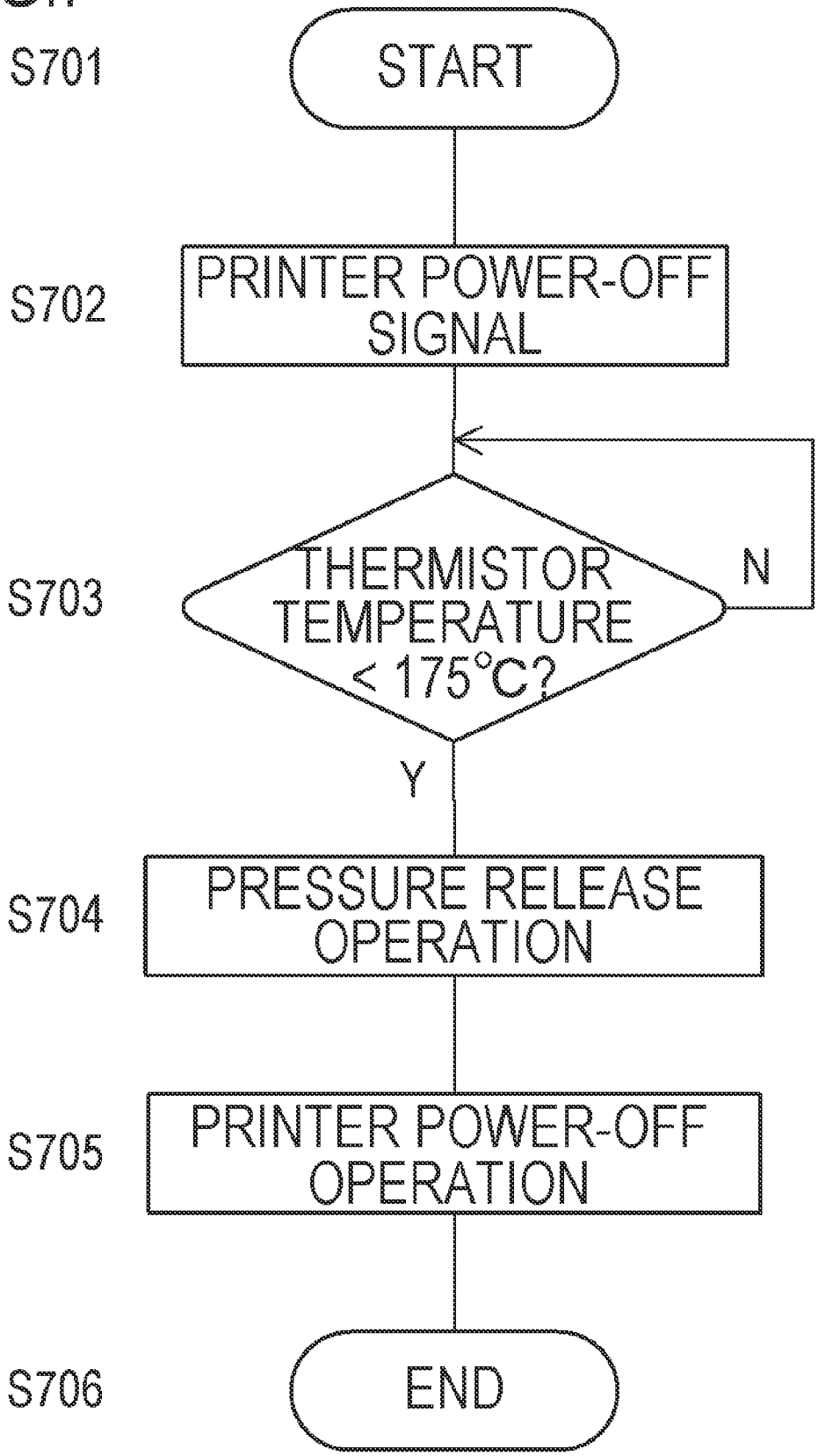
FIG. 7 is a flowchart of control of pressure release when the power of a printer is turned off.
Figure 8:
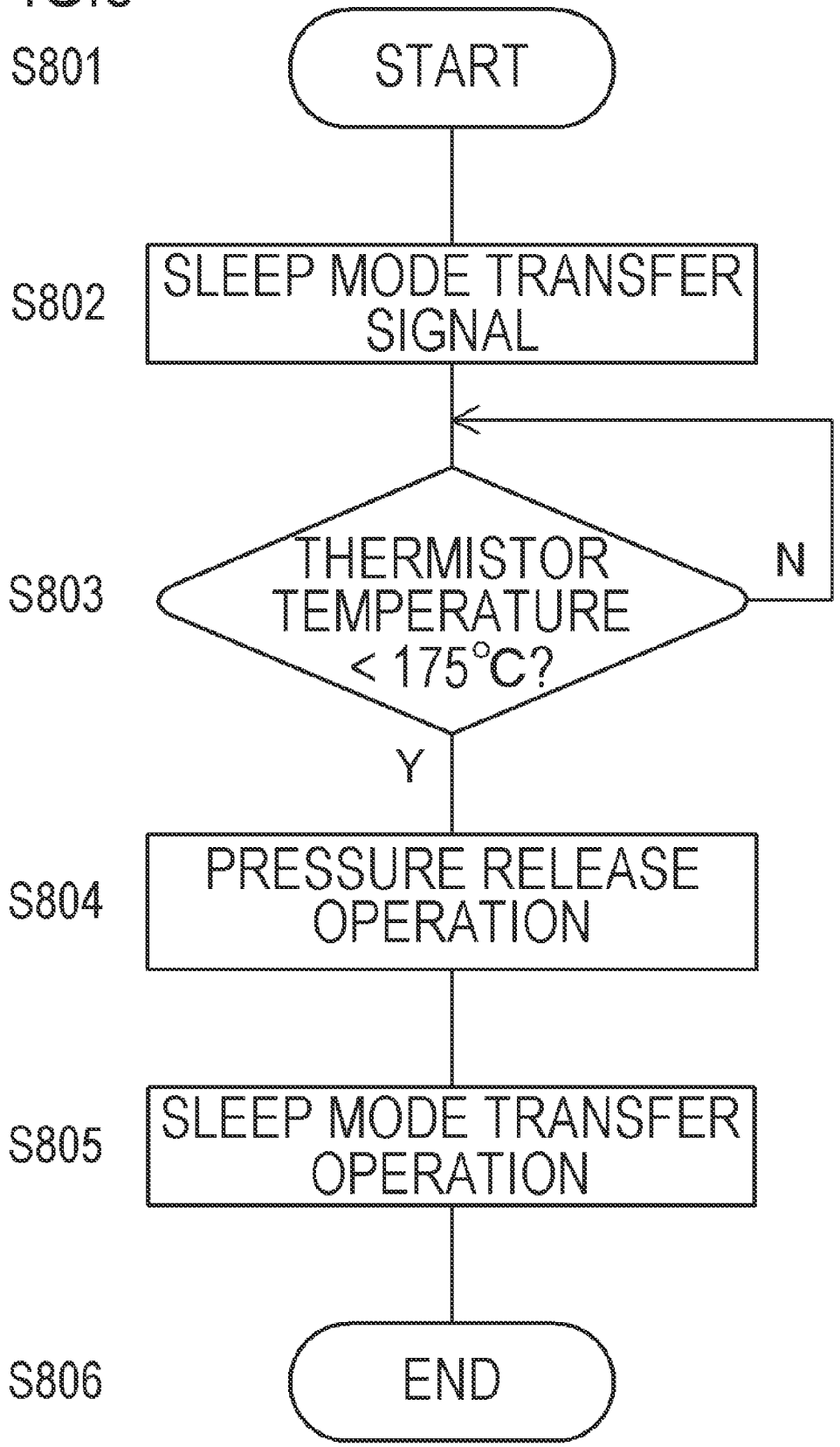
FIG. 8 is a flowchart of control of pressure release at the time of transfer to a sleep mode.

FIGS. 6 to 8 each illustrate a control flowchart of releasing pressing three of the fixing apparatus 200 in the present embodiment. Hereinafter, operation will be described with reference to each of the flowcharts.

FIG. 6 illustrates operation when the laser printer 100 detects jamming of the recording material P. When the laser printer 100 detects jamming (S603) during print operation (S602), the laser printer 100 stops the print operation to stop electrical heating of the heater 210 (S604). Next, detection unit (not illustrated) detects whether the recording material P remains in the fixing apparatus 200 (S605). When the recording material P remains, processing waits until temperature detected by each of the thermistors 250, 251, and 252 is below a predetermined threshold, or 175° C. in the present embodiment (S606), and then pressing force of the fixing apparatus 200 is released (S607). When no recording material P remains in S605, pressing three of the fixing apparatus 200 does not need to be released. In the present embodiment, after it takes two seconds at the maximum for waiting time in S606, pressing force of the fixing apparatus 200 is released, and then the jammed recording material P can be removed.

FIG. 7 illustrates operation when power of the laser printer 100 is turned off. When a signal of turning off power of the printer is transmitted by operation of turning off a power source of a main body, such as pushing a power source button of the laser printer 100 (S702), the processing waits until temperature detected by each of thermistors 250, 251, and 252 is below a predetermined threshold, or 175° C. in the present embodiment (S703), and then pressing force of the fixing apparatus 200 is released (S704). After the processing proceeds through another operation when the power is turned off (S705), the entire operation of the laser printer 100 stops. The temperature of each of thermistors sufficiently lowers to below the threshold except immediately after finish of a print job, so that pressure release operation immediately starts in response to the signal of turning off power.

FIG. 8 illustrates operation when the laser printer 100 transfers to the sleep mode. When a signal of transfer to the sleep mode is transmitted, such as when the laser printer 100 receives no print signal for a predetermined time (S802), the processing waits until temperature detected by each of thermistors 250, 251, and 252 is below a predetermined threshold, or 175° C. in the present embodiment (S803), and then pressing force of the fixing apparatus 200 is released (S804). After the processing proceeds through another operation during transfer to the sleep mode (S805), the laser printer 100 transfers to the sleep mode. The temperature of each of thermistors sufficiently lowers to below the threshold except immediately after finish of a print job, so that pressure release operation immediately starts in response to the signal of transfer to the sleep mode.

When the control flows of the present invention are not used, pressing force of the fixing apparatus 200 is released according to a control flow except S606 in FIG. 6 when jamming is detected, for example. However, pressing may be released at a thermistor temperature of 230° C. depending on circumstances. As described above, interface peeling force of the adhesive 280 decreases at high temperature. This causes decrease in a margin between force separating the heater 210 from the heater holder 220 using pressing force of the thermistors (250, 251, 252) and the safety element 260, and the interface peeling force of the adhesive 280, when pressing is released. When this kind of release of pressing is repeated, the interface peeling force may further deteriorate. This requires the number of releases of pressing of the fixing apparatus 200 to be limited, and thus the limitation may be rate-limiting of a life of the fixing apparatus 200.

As described above, pressing force of the fixing apparatus is released while temperature transfer of the fixing apparatus is monitored when jamming is detected in the image forming apparatus, when power of the printer is turned off and during transfer to the sleep mode. This enables ensuring a margin on adhesive interface peeling between the heater and the heater holder, so that influence on a life of the fixing apparatus due to pressure release can be reduced.

The temperature threshold for pressure release is to be appropriately adjusted in accordance with interface peeling force suitable for structure of the fixing apparatus. Specifically, the temperature threshold is preferably set to a value capable of ensuring a margin on interface peeling force of an adhesive, in accordance with physical properties of the adhesive, a shape of an adhesive point, an adhesive range, placement and pressing force of a pressing member, and the like.

In the present embodiment, the temperature threshold for pressure release is set using temperature detected by the thermistor disposed in contact with the heater. Besides this, even when pressure release is controlled by predicting temperature of the adhesive using means for detecting temperature of the heater holder, the film, and the pressing roller, the effects of the present invention can be acquired.

The present embodiment is described for an example in which the thermistors and the safety element are disposed on a heater back surface (a surface of the heater, opposite to a surface close to the fixing nip) as the pressing member. Besides this, the effects of the present invention can be acquired even in an example in which an electrode for generating heat by being energized is disposed on the heater back surface, and a contact member for supplying power to the electrode is disposed as a pressing member.

Embodiment 2

Embodiment 1 is described for an example of a method of controlling release of pressing of the controlling fixing apparatus 200, in which when temperature of the thermistor lowers to below a predetermined temperature threshold, the pressure release operation is performed. Embodiment 2 is described for an example in which a temperature threshold for release of pressing is changed in accordance with the number of repeats of pressure release that is performed when jamming is detected, when power of a printer is turned off, or during transfer to a sleep mode. Configurations of a laser printer and a fixing apparatus in the present embodiment are similar to those of Embodiment 1, and thus detailed description thereof is eliminated.

Figure 9:
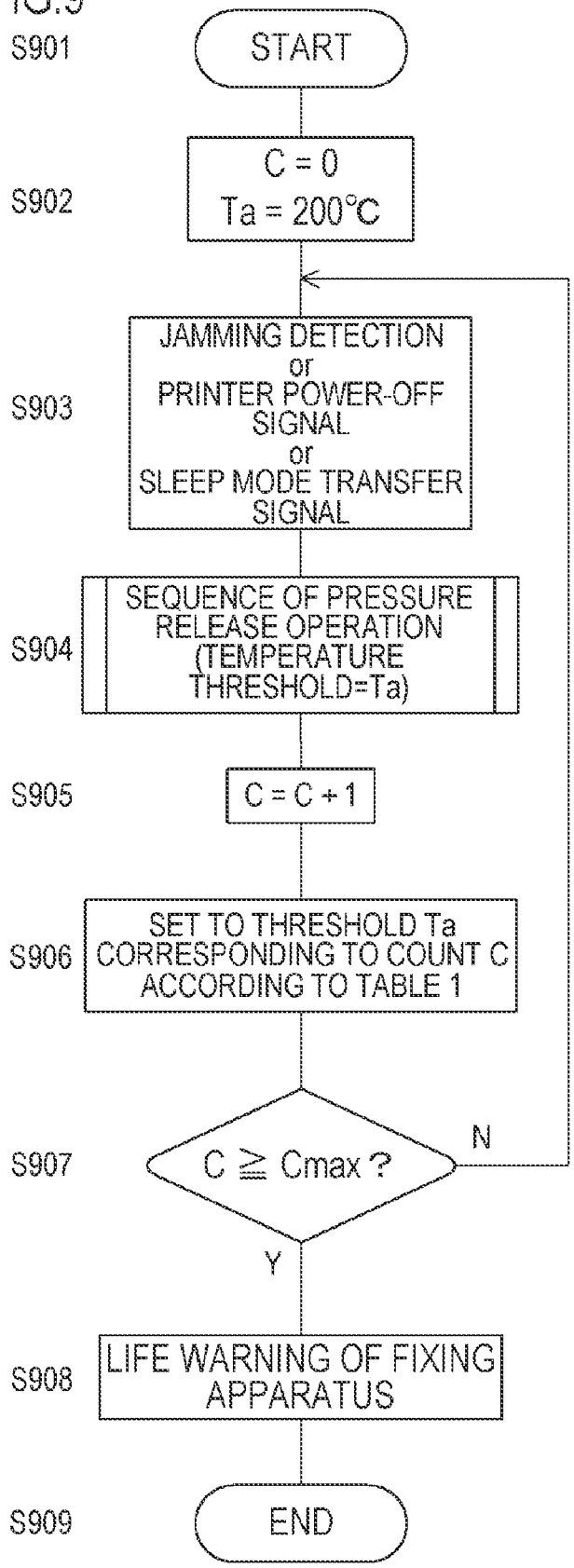
FIG. 9 is a flowchart of control of pressure release in Embodiment 2.

FIG. 9 is a control flowchart of the present embodiment. A temperature threshold for causing a fixing apparatus 200 to perform operation of release of pressing is designated as Ta (initial value is 200° C.). When jamming is detected, when power of a printer is turned off, or during transfer to a sleep mode (S903), a sequence of pressure release operation as in Embodiment 1, in which pressure release operation is performed when temperature detected by each of the thermistors (250, 251, and 252) is below the temperature threshold Ta is performed (S904). Then, the number of pressure releases C is counted up (S905), and a temperature threshold Ta is set to temperature corresponding to the count C according to Table 1 (S906). Table 1 is set such that as the number of pressure releases increases, the pressure release operation is performed at a lower temperature. When the number of pressure releases reaches an upper limit of count Cmax (S907), life warning of the fixing apparatus 200 is notified (S908). In the present embodiment, Cmax is set to 15000 counts. Cmax in the present embodiment is set to the number of counts that is counted after elapse of six years or more in typical office environment by assuming that the number of pressure releases per day is ten, and printer operation days per month are twenty days.

TABLE 1

| Number of pressure releases C | Temperature threshold Ta |
|---|---|
| $C < 5000$ | 200° C. |
| $5000 \leq C < 10000$ | 190° C. |
| $10000 \leq C < 15000$ | 180° C. |
| $15000 \leq C$ | 175° C. |

Performing control as in the present embodiment allows a margin on adhesive interface peeling while the number of repeats of pressure release is small, so that the pressure release operation can be performed in a shorter time. Then, the margin on adhesive interface peeling can be ensured by changing the temperature threshold as the number of repeats of pressure release increases.

Embodiment 3

Embodiment 3 is described for an example in which a temperature threshold for pressure release operation is changed in accordance with a thermal history of a fixing apparatus 200. Configurations of a laser printer and a fixing apparatus in the present embodiment are similar to those of Embodiment 1, and thus detailed description thereof is eliminated.

Figure 10:
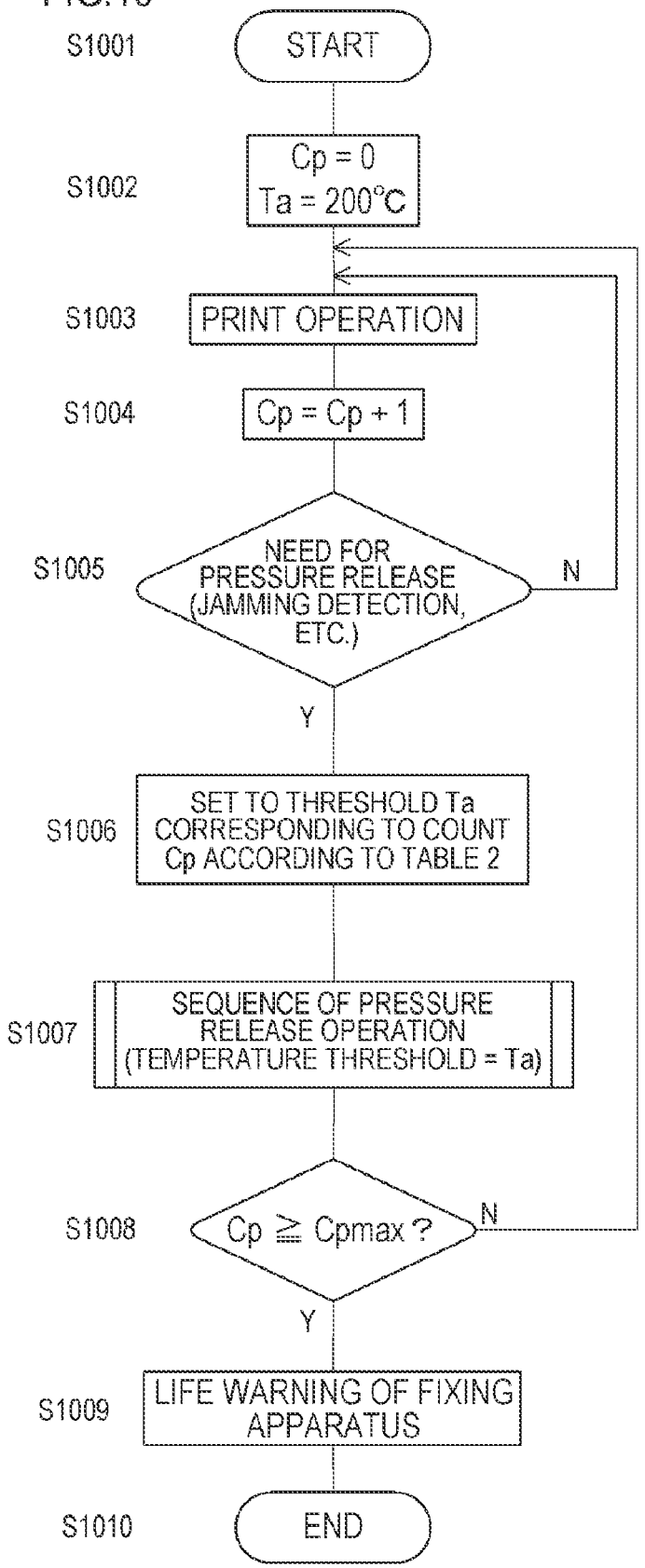
FIG. 10 is a flowchart of control of pressure release in Embodiment 3.

FIG. 10 is a control flowchart of the present embodiment. A temperature threshold for causing a fixing apparatus 200 to perform operation of release of pressing is designated as Ta (initial value is 200° C.). During print operation (S1003), a cumulative number of passes of sheets Cp of recording materials P is counted (S1004), and necessity of pressure release, such as that when jamming is detected, when power of a printer is turned off, or during transfer to a sleep mode, is determined (S1005). When it is determined to be necessary, the temperature threshold Ta is set to temperature corresponding to the cumulative number of passes of sheets Cp according to Table 2 (S1006), and then a sequence of pressure release operation as in Embodiment 1 is performed (S1007). Table 2 is set such that as the cumulative number of passes of sheets Cp of recording materials P increases, pressure release operation is performed at a lower temperature. When the cumulative number of passes of sheets reaches an upper limit Cpmax (S1008), life warning of the fixing apparatus 200 is notified (S1009). In the present embodiment, Cpmax is set to 150000 sheets.

TABLE 2

| Cumulative number of passes of sheets Cp | Temperature threshold Ta |
|---|---|
| Cp < 50000 | 200° C. |
| 50000 ≤ Cp < 100000 | 190° C. |
| 100000 ≤ Cp < 150000 | 180° C. |
| 150000 ≤ Cp | 175° C. |

Performing control as in the present embodiment allows a margin on adhesive interface peeling while the number of passes of sheets of the recording materials P is small, or the fixing apparatus has less thermal history and an adhesive has less thermal deterioration, so that the pressure release operation can be performed at earlier timing. Then, the margin on adhesive interface peeling can be ensured throughout a life of the fixing apparatus by changing the temperature threshold as the cumulative number of passes of sheets of sheets increases and thermal deterioration of an adhesive proceeds due to a thermal history of the fixing apparatus.

The present embodiment is described for an example in which the temperature threshold Ta is changed in accordance with a cumulative count of passes of sheets of the recording materials P. Besides this, similar effects can be acquired by changing the temperature threshold in accordance with a thermal history such as a cumulative estimate of heat storage of the fixing apparatus that is appropriately estimated using cumulative working time, a history of heating temperature and heating time, or the like of the fixing apparatus.

Although Embodiments 1 to 3 have been described, any modification within the technical idea of the present invention is possible. Although in Embodiments above, the thermistors, the safety element, and the contact member are exemplified as the pressing members that are pressed against the surface of the heater, opposite to the surface facing the film inner surface, the present invention is not limited to those. Additionally, various preset temperatures as predetermined thresholds may be each appropriately set to a temperature different from that described above in accordance with an apparatus configuration.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-050963, filed on Mar. 23, 2020, which is hereby incorporated by reference herein in its entirety.

What is claimed is:

1. An image heating apparatus configured to heat an image formed on a recording material, the image heating apparatus comprising:

a film formed a tubular shape and configured to rotate in contact with the recording material;

a heater unit configured to be in contact with an inner surface of the film, the heater unit including a heater, and a heater support configured to support the heater in a longitudinal direction of the heater, wherein the heater is fixed to the heater support with an adhesive;

a temperature detection member configured to detect the temperature of the heater;

a pressing roller configured to be in contact with an outer surface of the film and to form a nip together with the heater unit through the film, the nip being for nipping and conveying the recording material;

a pressing spring configured to press the heater toward the pressing roller through the heater support for forming the nip;

a pressing member configured to press the heater toward the pressing roller without passing through the heater support;

a pressing force adjustment mechanism configured to adjust the pressing force by the pressing spring; and a control portion configured to control the pressing force adjustment mechanism, wherein the control portion controls the pressing force adjustment mechanism to release or reduce the pressing force in at least one of the following cases:

when the recording material jams, when power of the apparatus is turned off, or when the apparatus enters the sleep mode, and wherein the control portion adjusts an operation timing of the pressing force adjustment mechanism in the case of releasing or reducing the pressing force by the pressing force adjustment mechanism based on a temperature detected by the temperature detection member.

2. The image heating apparatus according to claim 1, wherein the pressing member is a part of the temperature detection member.

3. The image heating apparatus according to claim 1, further comprising a safety element configured to prevent the heater from excessively increasing in temperature, wherein the pressing member is a part of the safety element.

4. The image heating apparatus according to claim 1, wherein the pressing member is a contact member configured to supply electric power to the heater.

5. The image heating apparatus according to claim 1, further comprising:

a jam detection unit configured to detect jamming of the recording material, wherein in a case that the jam detection unit detects jamming, and the temperature detected by the temperature detection member falls below a predetermined threshold, the control portion causes the pressing force adjustment mechanism to release or reduce the pressing force.

6. The image heating apparatus according to claim 1, further comprising:

a power source switching member configured to switch the start and stop of the image heating apparatus, wherein in a case that the power source switching member deactivates the image heating apparatus and the temperature detected by the temperature detection member falls below a predetermined threshold, the control portion causes the pressing force adjustment mechanism to release or reduce the pressing force.

7. The image heating apparatus according to claim 1, wherein the image heating apparatus has a normal power mode for heating the image, and a saving-power mode with a lower power consumption than the normal power mode, and wherein in a case that the image heating apparatus transfers from the normal power mode to the saving-power mode, and temperature detected by the temperature detection member falls below a predetermined threshold, the control portion causes the pressing force adjustment mechanism to release or reduce the pressing force.

8. The image heating apparatus according to claim 5, wherein the control portion is configured to change the threshold in accordance with the number of times when the pressing force adjustment mechanism has previously released or reduced the pressing force.

9. The image heating apparatus according to claim 5, wherein the control portion is configured to change the threshold in accordance with a thermal history of the image heating apparatus.

10. The image heating apparatus according to claim 9, wherein the thermal history is a cumulative number of recording materials passing through the nip.

11. The image heating apparatus according to claim 9, wherein the thermal history is a cumulative working time of the image heating apparatus.

12. The image heating apparatus according to claim 9, wherein the thermal history is a cumulative estimate of heat storage of the image heating apparatus.

13. An image forming apparatus comprising:

an image forming portion configured to form an image on a recording material; and a fixing portion configured to fix the image formed on the recording material to the recording material, wherein the fixing portion is the image heating apparatus according to claim 1.

14. An image forming apparatus for forming a toner image on a recording material, comprising:

an image forming unit configured to form the toner image on the recording material;

a fixing unit configured to fix the toner image formed on the recording material to the recording material, the fixing unit including a tubular film, a heater provided in an inner space of the film along a longitudinal direction of the film, a heater support provided in the inner space of the film along the longitudinal direction of the film and configured to support the heater along the longitudinal direction of the film, a roller which contacts an outer surface of the film and configured to form a fixing nip portion for pinching and conveying the recoding material in cooperation with the heater through the film, a temperature detection member configured to detect a temperature of the heater, a pressing member configured to press the heater in a direction to separate it from the heater support, a pressing mechanism configured to form the nip portion by applying a pressing force between the heater and the roller through the heater support at both end portions of the heater in the longitudinal direction of the film, and a pressing release cam configured to release or reduce the pressing force by acting on the pressing mechanism; and a control portion configured to control the pressing release cam, wherein the control portion controls the cam to release or reduce the pressing force in at least one of the following cases:

when the recording material jams, when a power of the apparatus is turned off, or when the apparatus enters the sleep mode, and wherein the control portion sets a timing for releasing or reducing the pressing force to the timing after a temperature detected by the temperature detection member falls below a predetermined threshold.

15. The image forming apparatus according to claim 14, wherein the temperature detection member is provided so as to contact a surface of the heater opposite to a surface facing the roller, and wherein the pressing member is a pressing spring for pressing the temperature detection member against the heater.

16. The image forming apparatus according to claim 14, wherein the fixing unit includes a safety element for preventing the heater from excessively increasing in temperature, wherein the safety element is provided so as to contact a surface of the heater opposite to a surface facing the roller, and wherein the pressing member is a pressing spring for pressing the safety element against the heater.

17. The image forming apparatus according to claim 14, wherein the fixing unit includes a contact member for supplying electric power to the heater, wherein the contact member is provided so as to contact a surface of the heater opposite to a surface facing the roller, and wherein the pressing member is the contact member.

18. The image forming apparatus according to claim 14, wherein the control portion changes the threshold in accordance with the number of times of releasing or reducing the pressing force, and wherein the threshold becomes lower as the number of times of releasing or reducing the pressing force increases.

19. The image forming apparatus according to claim 14, wherein the control portion changes the threshold in accordance with a cumulative number of recording materials passing through the fixing nip portion, and wherein the threshold is lower as the cumulative number of recording materials increases.

20. An image forming apparatus for forming a toner image on a recording material, comprising:

an image forming unit configured to form the toner image on the recording material;

a fixing unit configured to fix the toner image formed on the recording material to the recording material, the fixing unit including a tubular film, a heater provided in an inner space of the film along a longitudinal direction of the film, a heater support provided in the inner space of the film along the longitudinal direction of the film and configured to support the heater along the longitudinal direction of the film, a roller which contacts an outer surface of the film and configured to form a fixing nip portion for pinching and conveying the recoding material in cooperation with the heater through the film, a pressing member configured to press the heater in a direction to separate it from the heater support, a pressing mechanism configured to form the nip portion by applying a pressing force between the heater and the roller through the heater support at both end portions of the heater in the longitudinal direction of the film, and a pressing release cam configured to release or reduce of the pressing force by acting on the pressing mechanism; and a control portion configured to control the pressing release cam, wherein the control portion controls the cam to release or reduce the pressing force in at least one of the following cases:

when the recording material jams, when a power of the apparatus is turned off, or when the apparatus enters the sleep mode, and wherein the control portion sets a timing for releasing or reducing the pressing force to the timing after a temperature of the heater falls below a predetermined threshold.

* * * * *